US008997409B1

(12) United States Patent
Lashley et al.

(10) Patent No.: US 8,997,409 B1
(45) **Date of Patent: *Apr. 7, 2015**

(54) COUPLING DEVICE FOR FORMING A PROTECTIVE BUILDING SYSTEM

(71) Applicant: MB Industries, LLC, Shreveport, LA (US)

(72) Inventors: Patrick Crawford Lashley, Shreveport, LA (US); Alberto Manuel Garcia, Pleasant View, TN (US)

(73) Assignee: MB Industries, LLC, Shreveport, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/894,391

(22) Filed: May 14, 2013

Related U.S. Application Data

(63) Continuation-in-part of application No. 13/216,058, filed on Aug. 23, 2011, now Pat. No. 8,438,791.

(51) Int. Cl.
*E04D 3/36* (2006.01)
*E04D 1/36* (2006.01)
*E04H 9/04* (2006.01)

(52) U.S. Cl.
CPC ... *E04H 9/04* (2013.01); *E04D 3/36* (2013.01)

(58) Field of Classification Search
USPC ..... 52/90.1, 91.3, 198, 199, 287.1, 288.1, 52/465, 466, 467, 468, 469; 89/36.04
See application file for complete search history.

(56) References Cited

U.S. PATENT DOCUMENTS

| | | | | |
|---|---|---|---|---|
| 837,437 | A * | 12/1906 | Gerichten | 52/464 |
| 1,016,118 | A * | 1/1912 | Wendler | 52/464 |
| 1,323,336 | A * | 12/1919 | Thompson et al. | 52/461 |
| 1,536,977 | A * | 5/1925 | Skipworth | 52/11 |
| 1,906,524 | A * | 5/1933 | Bonsall | 52/39 |
| 6,128,870 | A * | 10/2000 | Kohler | 52/199 |
| 6,735,912 | B2 * | 5/2004 | Riggio | 52/235 |

* cited by examiner

*Primary Examiner* — Brent W Herring
(74) *Attorney, Agent, or Firm* — Buskop Law Group, PC; Wendy Buskop

(57) ABSTRACT

A modular building removable coupling device for forming an explosion resistant, forced entry resistant, and/or ballistic resistant facility. The coupling device can include two hollow square or rectangular tubings having hollow top sides, a sealing means disposed between the tubings, a fastener connecting the tubings, a roof plate secured to each tubing, and a roof cap disposed over the roof plates. The coupling device can include sealing tubes secured to inner sides of the roof cap. A plurality of explosion resistant, forced entry resistant, and/or ballistic resistant modules can be connected with a plurality of modular building removable coupling devices to form an explosion resistant, forced entry resistant, and/or ballistic resistant facility.

6 Claims, 5 Drawing Sheets

COUPLING DEVICE FOR FORMING A PROTECTIVE BUILDING SYSTEM

CROSS REFERENCE TO RELATED APPLICATIONS

The current application is a Continuation Application of patent application Ser. No. 13/216,058 filed on Aug. 23, 2011 entitled "COUPLING DEVICE FOR FORMING A PROTECTIVE BUILDING SYSTEM" which issued as U.S. Pat. No. 8,438,791 on May 14, 2013 and claims priority and the benefit of U.S. Provisional Patent Application Ser. No. 61/376,132 filed on Aug. 23, 2010 entitled "COUPLING DEVICE FOR FORMING A PROTECTIVE BUILDING SYSTEM". These references are hereby incorporated in their entirety.

FIELD

The present embodiments generally relate to coupling devices for forming a protective building system.

BACKGROUND

A need exists for an easy to install modular building removable coupling device for forming an explosion resistant, forced entry resistant, and/or ballistic resistant facility.

A need exists for an easy to install explosion resistant, forced entry resistant, and/or ballistic resistant facility having a plurality of explosion resistant, forced entry resistant, and/or ballistic resistant modules connected with a plurality of modular building removable coupling devices.

A further need exists for a facility that can resist both a category 5 hurricane a level 12 earthquake without deforming or detaching from the coupling device and a level IV ballistic impact without exploding, deforming, or detaching from the coupling device.

The present embodiments meet these needs.

BRIEF DESCRIPTION OF THE DRAWINGS

The detailed description will be better understood in conjunction with the accompanying drawings as follows.

Figure 1:
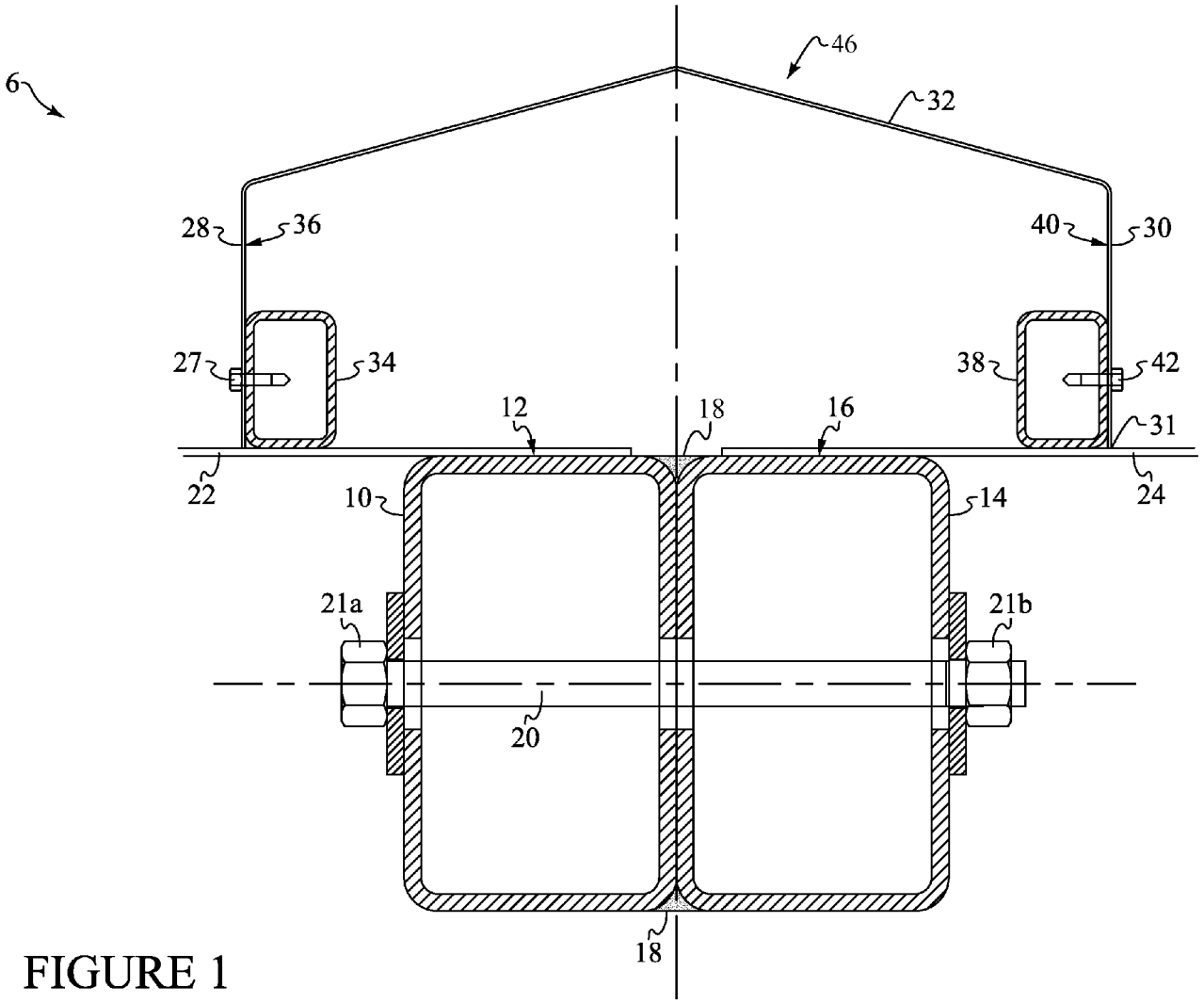
FIG. 1 is a cutaway embodiment of the coupling device.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to coupling devices for forming a protective building system which have two or more modular components connected together.

The present embodiments further relate to a facility that can be an explosion resistant, forced entry resistant, and/or ballistic resistant facility made from at least two explosion resistant, forced entry resistant, and/or ballistic resistant modules connected with one or more coupling devices. Each coupling device can be a modular building removable coupling device.

The coupling device can have a first hollow square or rectangular tubing having a first hollow top side. The coupling device can also have a second hollow square or rectangular tubing with a second hollow top side.

A sealing means can be disposed or placed between the first hollow square or rectangular tubing and the second hollow square or rectangular tubing for providing a weather resistant connection between the two hollow square or rectangular tubings. The sealing means can be flexible and durable.

The sealing means can be a sealing tape, a gasket, an adhesive weather resistant gel, or combinations thereof.

The sealing means can further have three sealant tapes as a laminate, such as a three layer construction laminate.

A first sealant tape can be disposed on an inner side of the first hollow square or rectangular tubing. A second sealant tape can be disposed on an inner side of the second hollow square or rectangular tubing. A third sealant tape can be disposed between the first sealant tape and the second sealant tape.

The sealant tapes can be used to join the first hollow square or rectangular tubing and the second hollow square or rectangular tubing together. One or more embodiments can include a laminate with less than three sealant tapes or a laminate with more than three sealant tapes.

The coupling device can have a fastener which can be centrally oriented to penetrate the first hollow square or rectangular tubing and the second hollow square or rectangular tubing. The fastener can connect the first hollow square or rectangular tubing to the second hollow square or rectangular tubing.

In one or more embodiments the fastener can be a bolt and nut assembly, such a 1 inch diameter nut on a 14 inch long bolt.

In one or more embodiments the fastener can be a bolt with a locking nut or a bolt with a locking washer.

The modular building removable coupling device can have a first roof plate secured to the first hollow square or rectangular tubing and a second roof plate secured to the second hollow square or rectangular tubing. The roof plates can extend beyond the hollow square or rectangular tubing.

A first roof cap side can connect perpendicularly to the first roof plate and a second roof cap side can connect perpendicularly to the second roof plate.

A roof cap top can be integrally connected between the first and second roof cap sides and above the first roof plate.

A first side sealing tube can be removably secured to an inner side of the first roof cap side, such as by using a first side fastener. The first side sealing tube can be non-removably secured to the first roof plate.

A second side sealing tube can be removably secured to an inner side of the second roof cap side, such as by using a second side fastener. The second side sealing tube can be non-removably secured to the second roof plate.

The modular building removable coupling device can include a bullet deflecting plate which can be welded to one of the roof plates while resting on the other roof plate.

The bullet deflecting plate can be disposed or positioned on a side of the roof plates opposite the first hollow square or rectangular tubing and the second hollow square or rectangular tubing.

The coupling device can hold two explosion resistant, forced entry resistant, and/or ballistic resistant housing modules or modular building components together in a removable engagement. For example, a first explosion resistant, forced entry resistant, and/or ballistic resistant housing module can be coupled to a second explosion resistant, forced entry resistant, and/or ballistic resistant housing module using the explosion resistant, forced entry resistant, and/or ballistic resistant coupling device, thereby forming the explosion resistant, forced entry resistant, and/or ballistic resistant facility.

In one or more embodiments, a removable bullet deflecting coupling device can be formed for connecting two explosion resistant, forced entry resistant, and/or ballistic resistant housing modules together and providing ballistic protection to the top of a facility.

The removable bullet deflecting coupling device can include a first hollow square or rectangular tubing that can have a first hollow top side. The removable bullet deflecting coupling device can include a second hollow square or rectangular tubing that can have a second hollow top side. A sealing means, such as the sealant tape of three layers, can be disposed between the first hollow square or rectangular tubing and the second hollow square or rectangular tubing, providing a weather resistant connection.

The removable bullet deflecting coupling device can include a square or rectangular fastener that can be centrally oriented to penetrate and connect the first hollow square or rectangular tubing to the second hollow square or rectangular tubing.

The removable bullet deflecting coupling device can include a first roof plate that can be secured to the first hollow square or rectangular tubing and a second roof plate that can be secured to the second hollow square or rectangular tubing.

A bullet deflecting plate can be disposed over at least a portion of the first roof plate and the second roof plate, and over the first hollow square or rectangular tubing and the second hollow square or rectangular tubing.

The removable bullet deflecting coupling device can connect a first explosion resistant, forced entry resistant, and/or ballistic resistant housing module to a second explosion resistant, forced entry resistant, and/or ballistic resistant housing module, thereby providing ballistic protection to the top and sides of the facility.

In one or more embodiments, the first roof cap side can be connected at an angle from about 5 degrees to about 90 degrees to the first roof plate. The second roof cap side can connect at an angle from about 5 degrees to about 90 degrees to the second roof plate.

The housing modules connected using the coupling devices and a facility formed of the housing modules can resist a category 5 hurricane without deforming and without the housing modules detaching from each other or from the coupling devices.

The housing modules connected using the coupling devices and a facility formed of the housing modules can also resist a level IV ballistic impact without exploding, without deforming, and without the housing modules detaching from each other or from the coupling devices.

The housing modules connected using the coupling devices and a facility formed of the housing modules can resist a level 12 earthquake without deforming and without the housing modules detaching from each other or from the coupling devices.

The formed facility can be explosion resistant, forced entry resistant, and/or ballistic resistant such that the housing modules do not deform or detach from each other or from the coupling devices.

The explosion resistant, forced entry resistant, and/or ballistic resistant facility can include one modular building removable coupling device connected to at least three explosion resistant, forced entry resistant, and/or ballistic resistant housing modules.

The explosion resistant, forced entry resistant, and/or ballistic resistant facility can include housing modules that have at least a floor, at least three walls, a ceiling, at least one door, and at least one window.

The explosion resistant, forced entry resistant, and/or ballistic resistant facility can have in each module either none or more of the following: a power supply, a water connection, a sewer connection, an air conditioning system, a heating system, a chemical laboratory, a control room, a flow meter, a gas meter, a remote terminal unit, at least one office, an internet communication system, a cellular communication system, a locker room, at least one bedroom, at least one mudroom, at least one living room, at least one dining room, at least one entertainment area, a kitchen with appliances, a security system, an alarm system, a notification system, electronics, a smoking room, a gas detention system, a fire protection system, a pressurization system, at least one gun port, a storage area, a power generation unit, a fuel storage area, a lockout tag out security system, or combinations thereof.

Turning now to the Figures, FIG. 1 shows a modular building removable coupling device 6 for forming an explosion resistant, forced entry resistant and/or ballistic resistant facility.

A first hollow square or rectangular tubing 10 having a first hollow top side 12 is depicted joined to a second hollow square or rectangular tubing 14 having a second hollow top side 16.

A sealing means 18, shown here as a sealant tape, can be disposed between the first hollow square or rectangular tubing 10 and the second hollow square or rectangular tubing 12 providing a weather resistant connection.

Each of the hollow square or rectangular tubing can have holes in walls of the hollow square or rectangular tubing. The holes can be centrally aligned, allowing a fastener 20 to extend through both of the hollow square or rectangular tubing and to join the hollow square or rectangular tubings together. In one embodiment, the fastener 20 is a square or rectangular fastener centrally oriented to penetrate and connect the first hollow square or rectangular tubing 12 to the second hollow square or rectangular tubing 16.

The fastener 20 is centrally oriented to penetrate and connect the first hollow square or rectangular tubing 10 to the second hollow square or rectangular tubing 14. Nuts 21*a* and 21*b* can engage the ends of the fastener 20 to secure the fastener 20 to and through the hollow square or rectangular tubing.

A first roof plate 22 is secured to the first hollow top side 12. A second roof plate 24 is secured to the second hollow top side 16.

In one or more embodiments, the first roof plate 22 and the second roof plate 24 are not connected together and a space separates them. In one or more embodiments the first roof plate 22 and the second roof plate 24 can be connected together without a space separating the two roof plates. The first roof plate 22 and the second roof plate 24 can each have a size, such as 4 feet by 11 feet or 7 feet by 11 feet. The first roof plate 22 and the second roof plate 24 can each be a rectangular shape or a square or rectangular shape.

A roof cap 46 can be composed of a first roof cap side 28, a second roof cap side 30, and a roof cap top 32.

The first roof cap side 28 can connect at a right angle to the first roof plate 22. The second roof cap side 30 can connect at a right angle to the second roof plate 24. The roof cap sides and the roof plates can each be made from steel that can be 0.0747 inch thick.

A continuous application of caulk sealant 31 can be applied on the roof plates to help in providing a watertight engagement.

The roof cap top 32 can integrally connect between the first roof cap side 28 and the second roof cap side 30 above the first roof plate 22 and the second roof plate 24. The roof cap top 32 can be made from a bent 0.0747 inch plate forming a slightly pitched roof, or it can be made from two plates welded together forming the roof cap top.

A first side sealing tube 34 can support the roof cap 46. The first side sealing tube 34 can be removably secured to an inner side 36 of the first roof cap side 28, such as by using a first side fastener 27. The first side sealing tube 34 can be non-removably secured to the first roof plate 22. The first side sealing tube 34 can extend the full length and sides of the building in a seamless manner.

A second side sealing tube can be used to support the roof cap 46. The second side sealing tube 38 can be removably secured to an inner side 40 of the second roof cap side 30, such as by using a second side fastener 42.

The first side fastener 27 can penetrate the first roof cap side 28 and a wall of the first side sealing tube 34 to provide a non-removable secure engagement to the first roof plate 22. The second side fastener 42 can penetrate the second roof cap side 30 and a wall of the second side sealing tube 38 to provide a non-removable secure engagement to the second roof plate 24. Both side sealing tubes can be caulked with a sealant to the roof plates, providing a water tight connection.

Figure 2:
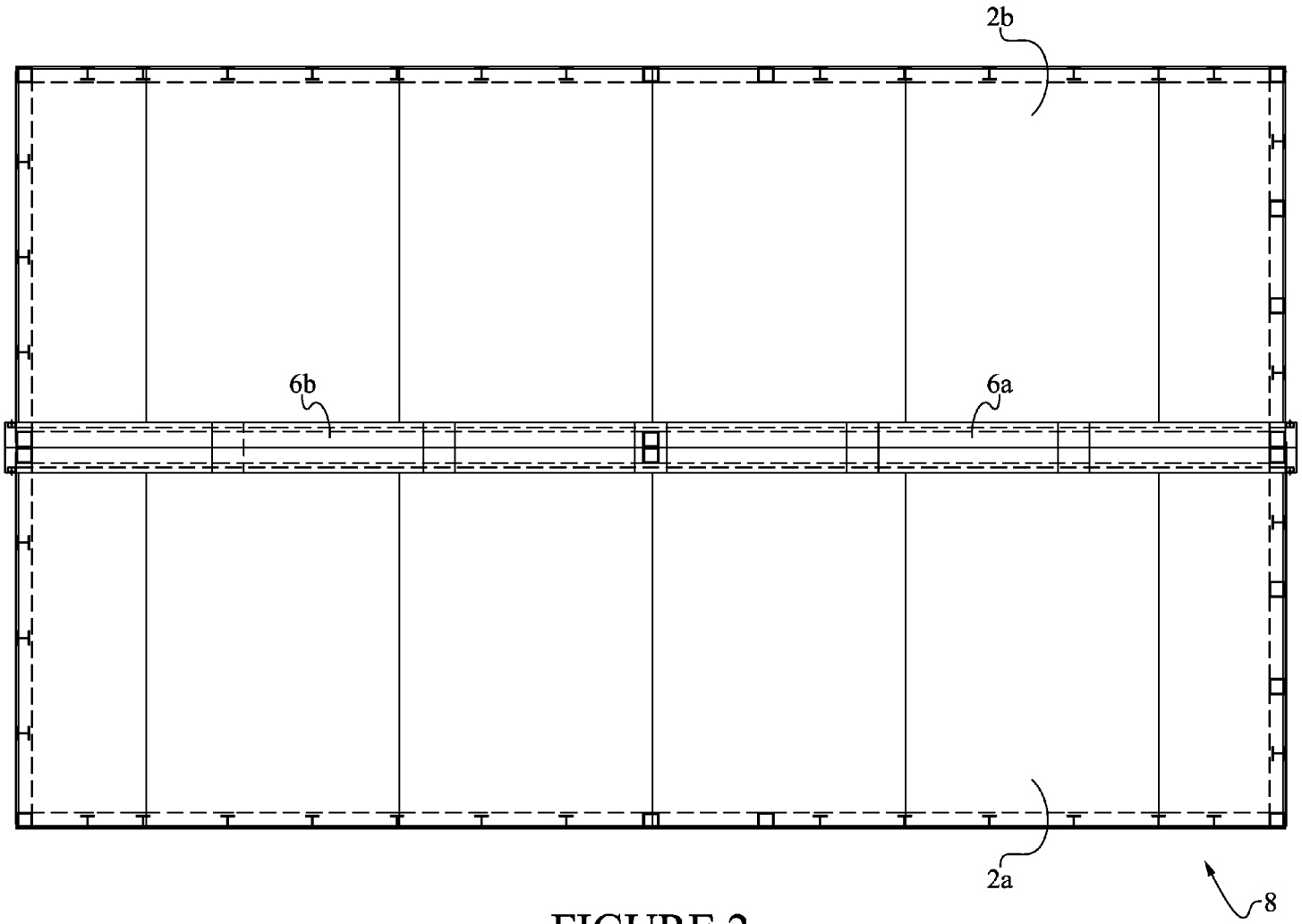
FIG. 2 is a top view of two modular buildings connected with the coupling device.

FIG. 2 shows an embodiment of coupling devices holding housing modules together from a top view, forming an explosion resistant, forced entry resistant, and/or ballistic resistant facility 8.

A linear array of a plurality of individual modular building removable coupling devices 6*a* and 6*b* are connected together.

The plurality of individual modular building removable coupling devices 6*a* and 6*b* are both connected to a plurality of first housing modules 2*a* and to a plurality of second housing modules 2*b*.

Figure 3:
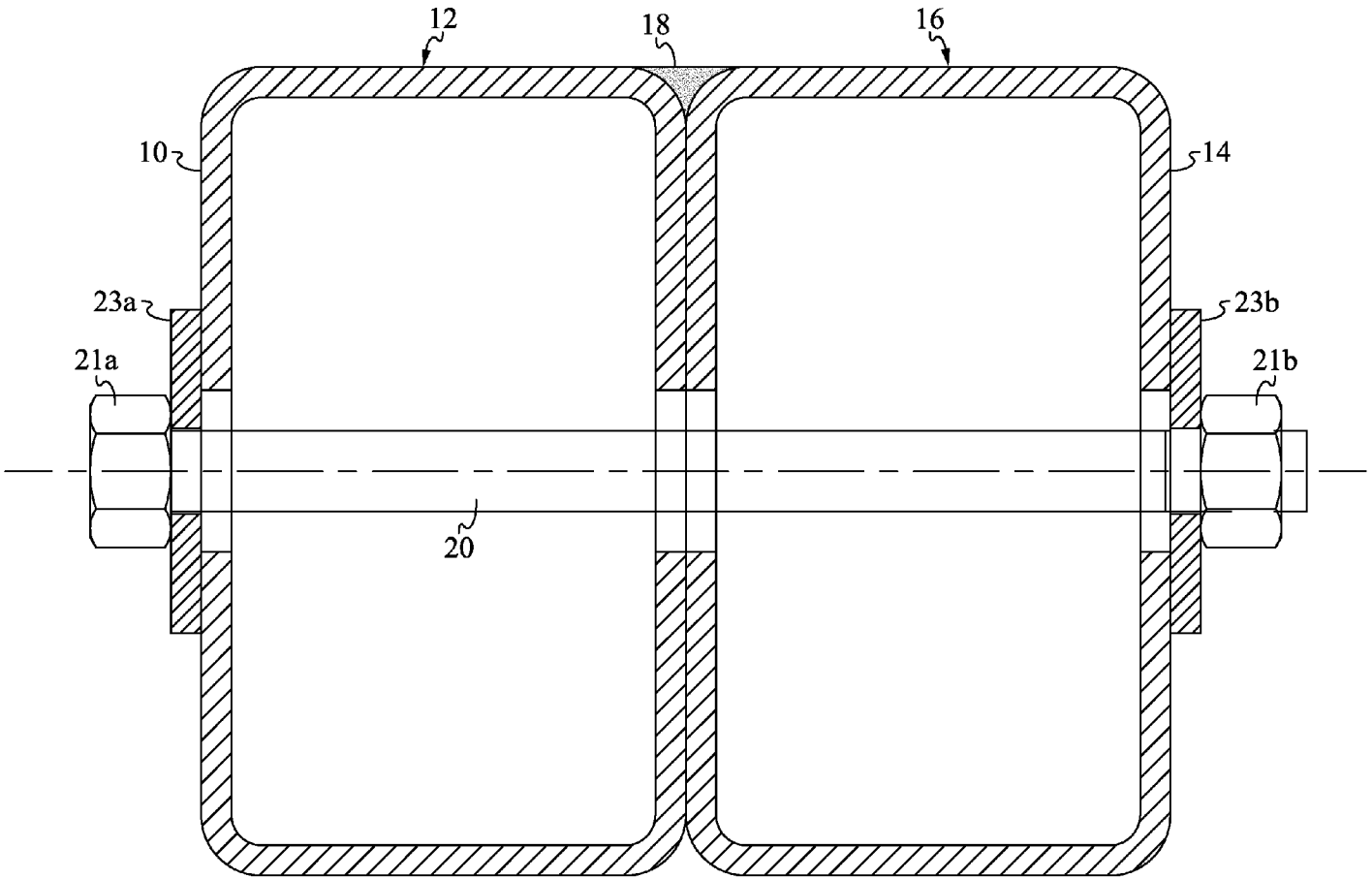
FIG. 3 is a detailed view of a portion of the coupling device.

FIG. 3 shows a detailed view of the fastener 20, here shown as a stud engaged with the nuts 21*a* and 21*b* and washers 23*a* and 23*b*. The fastener 20 is depicted penetrating through and engaging the first hollow square or rectangular tubing 10.

The fastener 20 is depicted penetrating through and engaging the second hollow square or rectangular tubing 14.

The tubing fastener 20, engaged with the nuts 21*a* and 21*b*, can occur along the lengths of the roof and all of the module to module connections. In an embodiment, the roof can have sixteen fasteners and the walls can have eight fasteners.

Also shown is the first hollow top side 12, the second hollow top side 16, and the sealing means 18.

Figure 4:
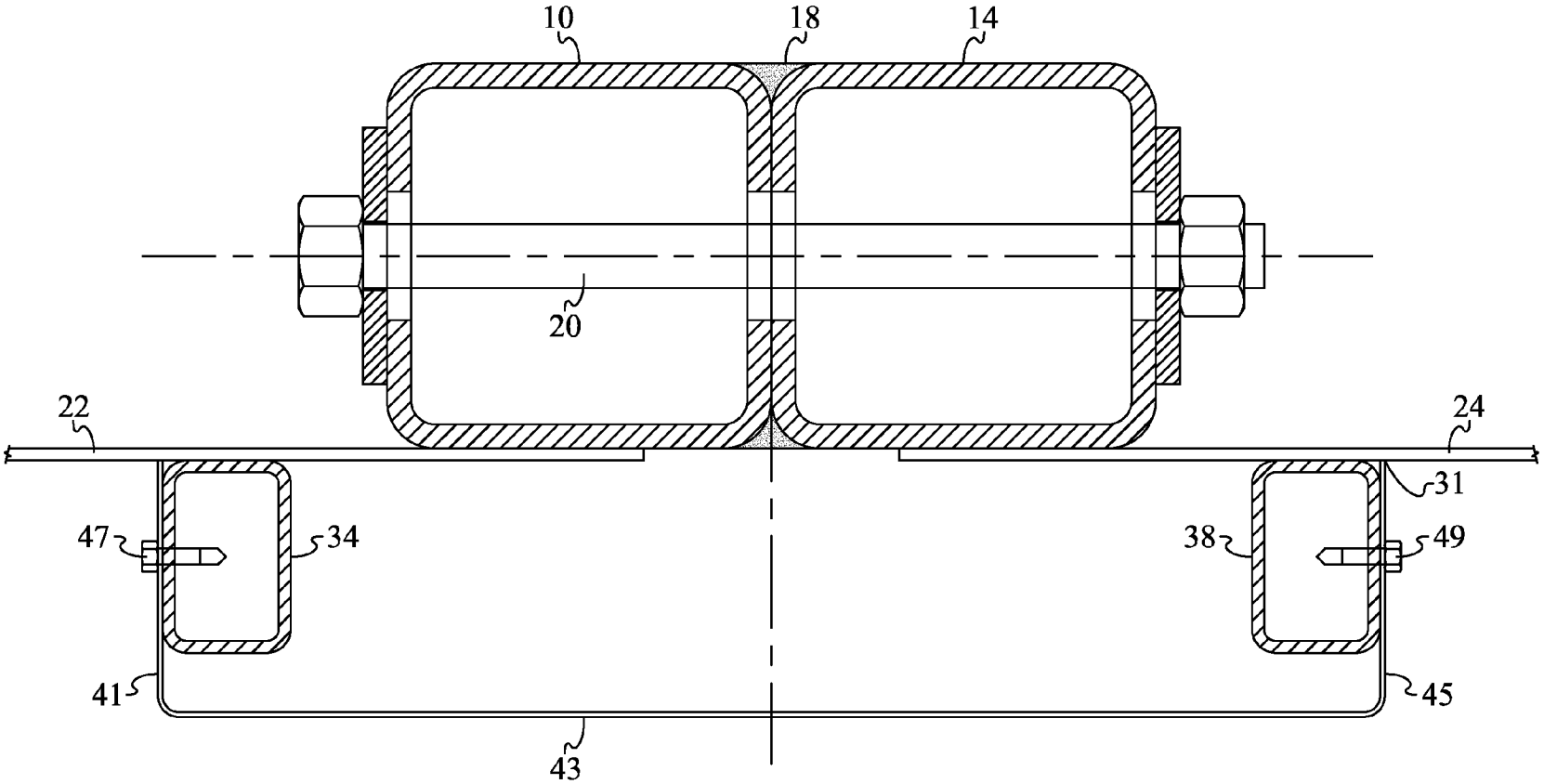
FIG. 4 is another embodiment of the coupling device.

FIG. 4 shows another embodiment of the coupling device with the first hollow square or rectangular tubing 10 connected to the second hollow square or rectangular tubing 14 using the tubing fastener 20 and the sealant means 18, here shown as a sealant tape.

The first hollow square or rectangular tubing 10 is disposed on the first wall plate 22. The second hollow square or rectangular tubing 14 is disposed on the second wall plate 24. The first and second wall plates are separated by a space.

Beneath the first wall plate 22 and opposite the first hollow square or rectangular tubing 10 is the first side sealing tube 34 which is shown engaged to a first lower side 41 of a wall cap 43 using a first lower fastener 47. The continuous application of caulk sealant 31 can be applied on the wall plate 22 and the first lower side 41 of the wall cap 43 to help in providing a watertight engagement.

Similarly, beneath the second roof plate 24 and opposite the second hollow square or rectangular tubing 14 is the second side sealing tube 38 which is shown secured to the second lower side 45 opposite the first lower side 41 using a second lower fastener 49. The continuous application of caulk sealant 31 can be applied on the wall plate 24 and the first lower side 45 of the wall cap 43 to help in providing a watertight engagement.

Figure 5:
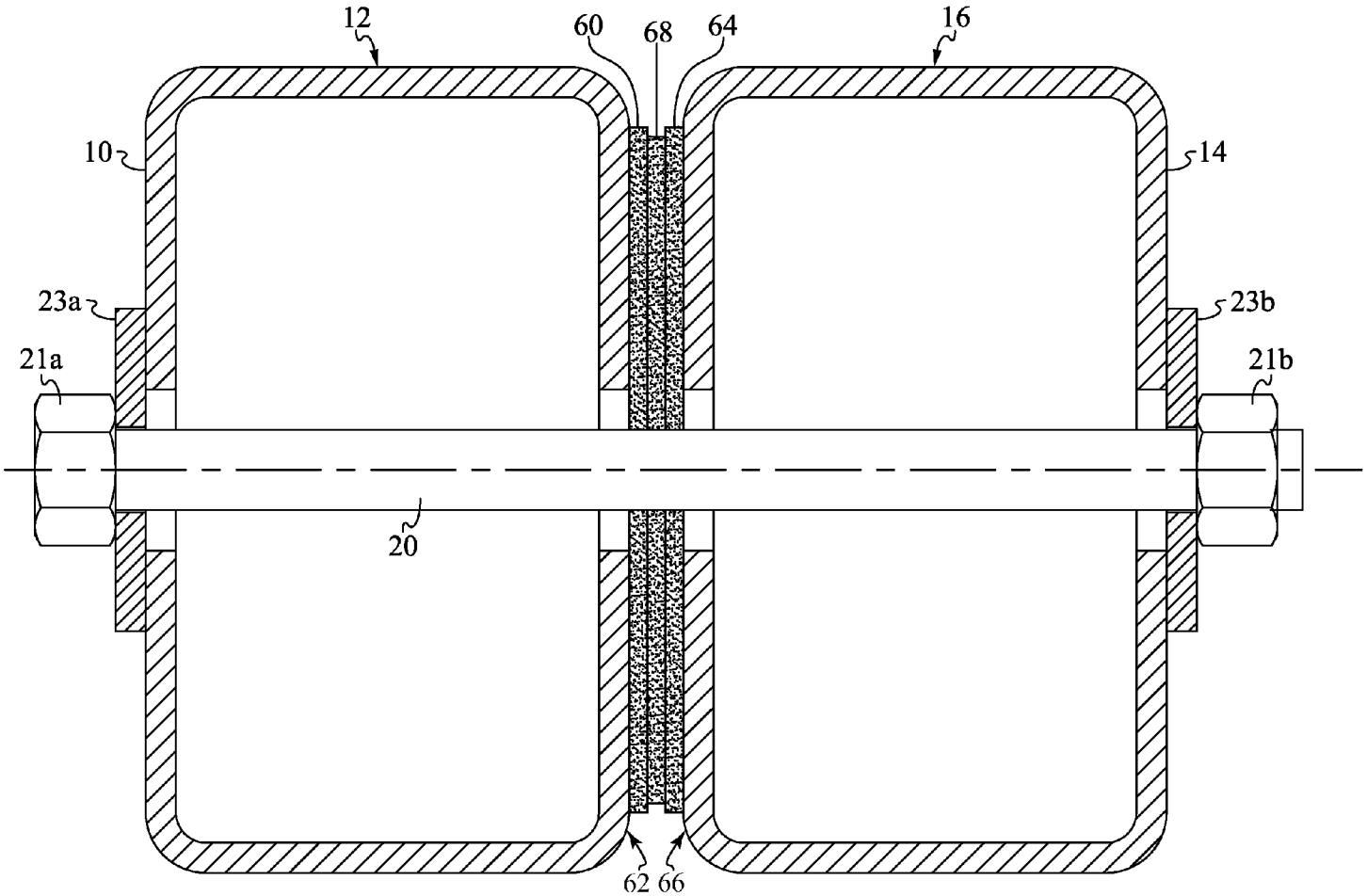
FIG. 5 is a detailed view of an embodiment of the sealant layer.

FIG. 5 shows an embodiment of the sealing means with a first sealant tape 60 disposed on a first side 62 of the first hollow square or rectangular tubing 10.

In one or more embodiments, the sealing means can include a second sealant tape 64 disposed on a second side 66 of the second hollow square or rectangular tubing 14.

In one or more embodiments, the sealing means can also have a third sealant tape 68 disposed between the first sealant tape 60 and the second sealant tape 64 and joining the first hollow square or rectangular tubing 10 to the second hollow square or rectangular tubing 14.

Also shown are the first hollow top side 12 and the second hollow top side 16.

The sealing means can be held together between the first hollow square or rectangular tubing 10 and the second hollow square or rectangular tubing 14 using the fastener 20. The fastener can be engaged using the nuts 21*a* and 21*b*. The nuts 21*a* and 21*b* can be supported by washers 23*a* and 23*b*.

While these embodiments have been described with emphasis on the embodiments, it should be understood that within the scope of the appended claims, the embodiments might be practiced other than as specifically described herein.

What is claimed is:

1. A modular building removable coupling device for forming an explosion resistant, forced entry resistant, and/or ballistic resistant facility comprising:

a. a first hollow square or rectangular tubing having a first hollow top side;

b. a second hollow square or rectangular tubing having a second hollow top side;

c. a sealing means disposed between the first hollow square or rectangular tubing and the second hollow square or rectangular tubing providing a weather resistant connection;

d. a fastener centrally oriented to penetrate and connect the first hollow square or rectangular tubing to the second hollow square or rectangular tubing;

e. a first roof plate secured to the first hollow square or rectangular tubing;

f. a second roof plate secured to the second hollow square or rectangular tubing;

g. a first side sealing tube non-removably secured to the first roof plate; and h. a second side sealing tube non-removably secured to the second roof plate, wherein the modular building removable coupling device connects a first explosion resistant, forced entry resistant, and/or ballistic resistant housing module to a second explosion resistant, forced entry resistant, and/or ballistic resistant housing module, forming the explosion resistant, forced entry resistant, and/or ballistic resistant facility.

2. The modular building removable coupling device of claim 1, wherein the sealing means is a member of the group consisting of: a sealing tape, a gasket, an adhesive weather resistant gel, and combinations thereof.

3. The modular building removable coupling device of claim 1, wherein the fastener is a bolt and nut assembly.

4. The modular building removable coupling device of claim 1, wherein the tubing fastener is a bolt with a locking nut or a bolt with a locking washer.

5. The modular building removable coupling device of claim 1, wherein the tubing fastener is a stud and nuts assembly.

6. The modular building removable coupling device of claim 1, wherein the sealing means comprises:

a. a first sealant tape disposed on a first side of the first hollow square or rectangular tubing;

b. a second sealant tape disposed on a second side of the second hollow square or rectangular tubing; and c. a third sealant tape disposed between the first sealant tape and the second sealant tape joining the first hollow square or rectangular tubing and the second hollow square or rectangular tubing together.

* * * * *